United States Patent [19]

Sanvito

[11] Patent Number: 4,493,277

[45] Date of Patent: Jan. 15, 1985

[54] WORKPIECE POSITIONER FOR SEWING UNITS

[75] Inventor: Roberto Sanvito, Milan, Italy

[73] Assignee: Rockwell-Rimoldi S.p.A., Italy

[21] Appl. No.: 537,768

[22] Filed: Sep. 30, 1983

[30] Foreign Application Priority Data

Jul. 4, 1983 [IT] Italy ..... 21456/83[U]

[51] Int. Cl.[3] ..... D05B 35/10

[52] U.S. Cl. ..... 112/153; 112/304

[58] Field of Search ..... 112/153, 304, 10, 152, 112/136, 147

[56] References Cited

U.S. PATENT DOCUMENTS

| | | | |
|---|---|---|---|
| 2,874,659 | 2/1959 | Kehrer | 112/10 |
| 3,496,891 | 2/1970 | Kosrow et al. | 112/153 X |
| 3,782,305 | 1/1974 | Robinette | 112/10 |
| 3,889,614 | 6/1975 | Nicolay et al. | 112/153 |
| 3,903,820 | 9/1975 | Kleinschmidt et al. | 112/153 |
| 4,132,184 | 1/1979 | Burton | 112/153 X |

FOREIGN PATENT DOCUMENTS

| | | | |
|---|---|---|---|
| 519947 | 4/1940 | United Kingdom | 112/153 |

*Primary Examiner*—Hampton H. Hunter

[57] ABSTRACT

A positioning device for advancing a workpiece to and orienting the same in the sewing zone of a sewing unit. The device includes a feed table having a plurality of slots upstream of the sewing zone which are disposed at an angle relative to the line of sewing. A driven endless belt is operatively associated with each slot in the feed table and are disposed so as to partially protrude their respective slot. That portion of the endless belts protruding through their respective slots are caused to engage the underside of a workpiece and are effective in advancing the same to a position in front of the sewing machine's presser foot and in close proximity with a vertical guide wall extending parallel to the line of sewing.

3 Claims, 1 Drawing Figure

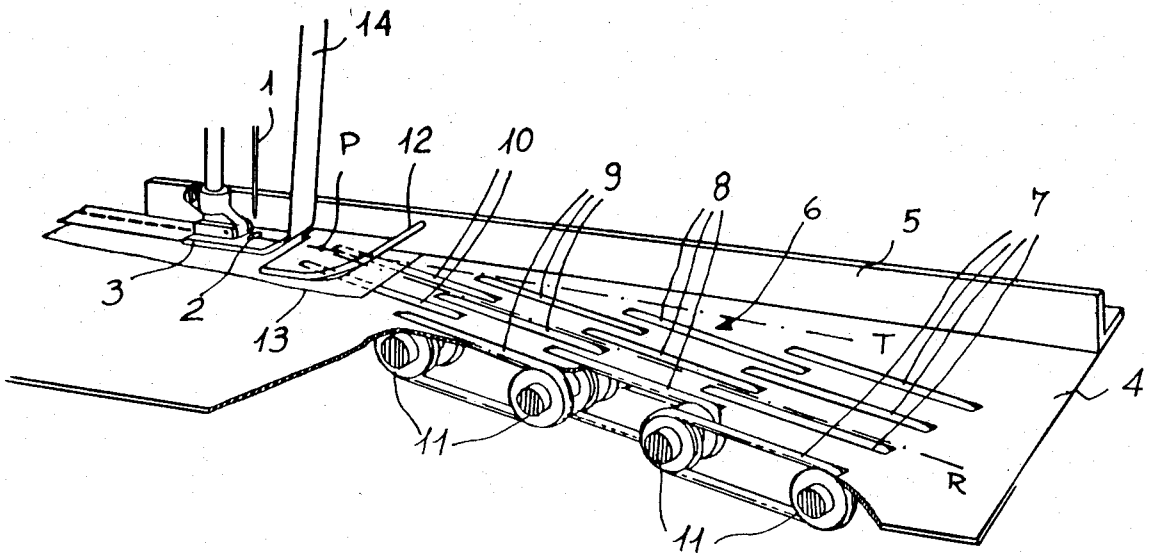
1
2
3
4
5
6
7
8
9
10
11
11
12
13
14
P
T
R

WORKPIECE POSITIONER FOR SEWING UNITS

BACKGROUND OF THE INVENTION

The present invention pertains to a device for advancing workpieces to and orienting the same in a position adjacent to the sewing zone in a sewing unit. In such sewing units, the workpieces are either fed continuously by an operator or by a mechanical feeder so that they become oriented in such a manner so as to be positioned in the sewing zone parallel to the feed line of the sewing machine that forms a part of said sewing unit.

Devices for advancing to and orienting workpieces in the sewing zone and in the line of feed of the unit's sewing machine by means of transmission belts are well known to those conversant in the art. Such known devices, however, have not been entirely satisfactory in the performance of their intended function for the workpieces are frequently subjected to uncontrolled displacement on the transmission belts. To correct the problem of workpiece displacement with devices of the prior art, inclined wheels or rollers provided with a helicoidal portion have been tried in combination with the transmission belts. This combination has been effective in applying a thrust in the direction of a vehicle guide wall which extends parallel to the feed line of the sewing machine. Certain patents show and describe prior art devices of the above type and for a more detailed description thereof, attention is directed to U.S. Pat. No. 3,903,820 and German Pat. No. 2,451,229.

The attempts to correct the problems of the prior art devices have not been completely satisfactory for the combinations of the wheels as rollers with the transmission belts has at times been ineffective and what is considered to be too slow since the alignment is accomplished by steps and depends on the initial position in which the workpiece is brought into engagement with the wheels and rollers. If this position is too great a distance from the ideal alignment, the workpiece will arrive at the sewing zone before it is correctly oriented resulting in sewing not being formed along the edge thereof as desired.

Another form of prior art device which utilizes two series of transmission belts disposed at right angles to one another is shown and described in German Pat. No. 1,949,525. Although this device performs its intended function satisfactorily, it is considered to be of excessive size and complexity.

The workpiece positioner for sewing units comprising the invention has overcome the troublesome and undesirable conditions described above by providing a device that accurately and continuously positions a workpiece in the most desirable location for forming a seam of stitches thereon.

SUMMARY OF THE INVENTION

The workpiece positioner for sewing units according to the invention includes a feed table disposed upstream of the sewing zone of said unit. The feed table is provided with a plurality of spaced slots that are parallel with one another and which are disposed at an angle relative to the line of sewing. An endless drive belt is operatively associated with each slot in the feed table and are disposed so as to partially protrude through their respective slots to engage the underside of a workpiece on the feed table. The plurality of endless drive belts are simultaneously driven by any suitable source of drive and being in engagement with the underside of the workpieces, they are effective in advancing the latter to the feed line of the machine at a position located upstream of the sewing zone and in orienting said workpieces so that they assume a position of close proximity with a vertical guide wall disposed substantially parallel with said feed line.

An object of the invention is to provide an improved device for advancing to and orienting a workpiece in the sewing zone of a sewing unit.

A more specific object of the invention is to provide a workpiece positioner for sewing units of simplified construction which will accurately and consecutively perform its intended function.

These and other objects of the invention will become more fully apparent by reference to the appended claims and as the following detailed description proceeds in reference to the FIGURE of drawings wherein:

BRIEF DESCRIPTION OF THE DRAWING

The single FIGURE of the drawing is a perspective view of the workpiece positioner according to the invention showing its association with a sewing machine.

DESCRIPTION OF THE PREFERRED EMBODIMENT

Referring now to the FIGURE of drawing the sewing unit to which the invention is applicable shows a portion of a sewing machine that includes a stitching needle. As is well known to those conversant in the art, the needle is caused to pass through and be withdrawn from an opening 2 in the machine's presser foot 3 in order to cooperate with the lower stitching instrumentalities (not shown) during the formation of stitches. The sewing unit also includes a workpiece feed table 4 on which a vertical guide wall 5 is mounted so as to extend substantially parallel to the line of feed that is depicted by the letter "T."

A feed and orientation device generally indicated by numeral 6 is provided with a plurality of series of transmission or endless drive belts with the various series thereof beng identified by numerals 7, 8, 9 and 10. The upper rectilinear portions of these belts project upwardly through elongated openings as slots in the planar surface of the feed table 4. Each series of transmission belts is operatively associated with an adjacent series and are angularly disposed relative to the feed lines that are identified by the letter "T." Being angularly disposed, the series of transmission belts disposed at the greatest distance from the sewing zone and from the feed line "T" are depicted by the numeral 10. The plurality of series of transmission belts are operatively connected to grooved roller 11 located beneath the feed table 4 and are rotatable driven simultaneously by any well known and suitable source of drive (not shown). As shown in the drawings, the trailing or downstream ends of each series of belts overlap the leading or upstream ends of the next succeeding series of belts, with the exception of series 7 and 12 which are the end series. Similarly, each successive series is juxtaposed or interfitted with each other series so that work to be sewn will be urged continuously toward wall 5 and, simultaneously, form a sewing zone. The driven grooved rollers 11 are effective in transmitting their motion to the transmission belts which as described are inclined in such a manner that their resultant line of action R encounters the feed line T at a point P lying upstream of the sewing zone and in close proximity with the vertical guide wall 5.

The various series of transmission or endless drive belts are disposed so as to be staggered relative to one another and the quantity in each series decreases in number the closer they are located to the sewing zone. In other words, as shown in the drawing, the series depicted by numeral 7 have the greatest number of endless drive belts and those depicted by numeral 10, being siituated adjacent the sewing zone, which corresponds to point P, have the least number of said endless drive belts.

An auxiliary guide member 12 may also be utilized and as shown in the FIGURE of drawing, it is disposed in operative association with the feed table 4 at a location in close proximity with and upstream of the sewing zone. This auxiliary guide member 12 serves to ensure that a workpiece 13 will be advanced to the sewing zone in a positive manner without the possibility of displacement in an upwardly direction. A flexible strip 14 drawn from any suitable source not shown, and passing under the sewing machine's presser foot 3, may as shown in the drawing, be sewn onto the workpiece 13.

It should be understood from the foregoing description that as the entire surface of workpiece 13 is acted upon by the endless drive belts 7, 8, 9 and 10, it is advanced in a positive manner so that its leading corner comes into engagement with the vertical guide wall 5 prior to its entrance into the sewing zone. Consequently, continued travel of the endless drive belts cause the workpiece 13 to pivot about its leading corner and turn it so that the opposed corners on the side to be sewn is also caused to engage the vertical guide wall 5.

Although the present invention has been described in connection with a preferred embodiment, it is to be understood that modifications and variations may be resorted to wthout departing from the spirit and scope of the invention as those skilled in the art will readily understand. Such modifications and variations are considered to be within the purview and scope of the invention and the appended claims.

I claim:

1. A workpiece positioner device for sewing units having a sewing machine with a presser foot and a stitching needle defining the unit's sewing zone, said workpiece positioner device comprising:

(a) a feed table (4) mounted on the sewing unit upstream of the sewing zone;

(b) a vertical guide wall (5) mounted on said feed table for guiding a workpiece along a line of feed extending parallel therewith; and (c) a series of overlapping interfitting drive elements each having a portion of its periphery protruding beyond the upper surface of said feed table and located to move the workpiece along a line of action (R) of the drive elements encountering the feed line (T) at a point (P) lying upstream of the sewing zone and in close proximity with the vertical guide wall 5.

2. A positioner device as defined in claim 1 wherein said drive elements comprise a series of endless belts entrained about pulleys and having one length thereof protruding above the surface of said feed table.

3. A positioner device as defined in claim 2 where each series of said belts has less belts than the preceding series in the direction moving toward the sewing guide.

* * * * *